US010118411B2

(12) United States Patent
Yoshinuma et al.

(10) Patent No.: US 10,118,411 B2
(45) Date of Patent: Nov. 6, 2018

(54) DRYING DEVICE AND PRINTING APPARATUS

(71) Applicants: Toshihiro Yoshinuma, Kanagawa (JP); Ken Onodera, Kanagawa (JP); Sho Sawahata, Tokyo (JP); Junji Nakai, Kanagawa (JP)

(72) Inventors: Toshihiro Yoshinuma, Kanagawa (JP); Ken Onodera, Kanagawa (JP); Sho Sawahata, Tokyo (JP); Junji Nakai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/462,183

(22) Filed: Mar. 17, 2017

(65) Prior Publication Data

US 2017/0266990 A1 Sep. 21, 2017

(30) Foreign Application Priority Data

Mar. 18, 2016 (JP) ..... 2016-056129
Feb. 2, 2017 (JP) ..... 2017-017510

(51) Int. Cl.
*B41J 11/00* (2006.01)

(52) U.S. Cl.
CPC ..... *B41J 11/002* (2013.01); *B41J 11/0045* (2013.01)

(58) Field of Classification Search
CPC ..... B41J 11/002; B41J 11/0045
See application file for complete search history.

(56) References Cited

U.S. PATENT DOCUMENTS

| | | | | |
|---|---|---|---|---|
| 9,409,416 | B2 * | 8/2016 | Onodera | B41F 23/042 |
| 9,605,900 | B2 | 3/2017 | Boland et al. | |
| 2014/0232797 | A1 | 8/2014 | Onodera et al. | |
| 2015/0174921 | A1 | 6/2015 | Onodera et al. | |
| 2016/0101635 | A1 | 4/2016 | Hoshino et al. | |
| 2016/0263914 | A1 | 9/2016 | Hoshino | |
| 2016/0273832 | A1 | 9/2016 | Asada et al. | |

FOREIGN PATENT DOCUMENTS

| | | |
|---|---|---|
| JP | 5-008373 | 1/1993 |
| JP | 2000-019877 | 1/2000 |
| JP | 2003-237049 | 8/2003 |
| JP | 2007-083566 | 4/2007 |
| JP | 2014-152964 | 8/2014 |
| JP | 2016-107519 | 6/2016 |

* cited by examiner

*Primary Examiner* — Lamson Nguyen
(74) *Attorney, Agent, or Firm* — Oblon, McClelland, Maier & Neustadt, L.L.P.

(57) ABSTRACT

A drying device includes a plurality of heaters and a conveyance path. The plurality of heaters is disposed side by side in a direction of conveyance of a medium to contact and heat the medium to which liquid is applied. The medium is conveyed on the conveyance path while contacting the plurality of heaters. The conveyance path includes a first path and a second path. On the first path, the medium is conveyed while contacting the plurality of heaters. On the second path, the medium is conveyed while contacting again at least one of the plurality of heaters having contacted on the first path.

19 Claims, 7 Drawing Sheets

| ROLLER DIAMETER (mm) | COCKLING HEIGHT (mm) | COCKLING PITCH (mm) | VISIBLE COCKLING |
|---|---|---|---|
| 250 | 0.11 | 5 | OBSERVED |
| 200 | 0.06 | 4 | OBSERVED |
| 150 | 0.06 | 4.5 | OBSERVED |
| 100 | 0.02 | NO PITCH | NOT OBSERVED |

DRYING DEVICE AND PRINTING APPARATUS

CROSS-REFERENCE TO RELATED APPLICATIONS

This patent application is based on and claims priority pursuant to 35 U.S.C. § 119(a) to Japanese Patent Application Nos. 2016-056129, filed on Mar. 18, 2016, and 2017-017510, filed on Feb. 2, 2017, in the Japan Patent Office, the entire disclosure of which is hereby incorporated by reference herein.

BACKGROUND

Technical Field

Embodiments of the present disclosure relate to a drying device and a printing apparatus.

Related Art

As a printing apparatus to apply liquid to a continuous sheet or the like to perform printing, for example, an apparatus is known that applies liquid to a continuous sheet or the like and then dries the liquid with a contact heater, such as a heating roller.

SUMMARY

In an aspect of the present disclosure, there is provided a drying device that includes a plurality of heaters and a conveyance path. The plurality of heaters is disposed side by side in a direction of conveyance of a medium to contact and heat the medium to which liquid is applied. The medium is conveyed on the conveyance path while contacting the plurality of heaters. The conveyance path includes a first path and a second path. On the first path, the medium is conveyed while contacting the plurality of heaters. On the second path, the medium is conveyed while contacting again at least one of the plurality of heaters having contacted on the first path.

In another aspect of the present disclosure, there is provided a printing apparatus that includes a liquid applicator and the drying device. The liquid applicator applies the liquid to the medium. The drying device dries the medium to which the liquid is applied.

In still another aspect of the present disclosure, there is provided a printing apparatus that includes a first liquid applicator, a first drying device, a second liquid applicator, and a second drying device. The first liquid applicator applies liquid to a first surface of the medium. The first drying device is constituted of the above-described drying device. The first drying device is disposed downstream from the first liquid applicator in the direction of conveyance of the medium. The second liquid applicator applies liquid onto a second surface of the medium, which is opposite to the first surface of the medium. The second liquid applicator is disposed downstream from the first drying device in the direction of conveyance of the medium. The second drying device is constituted of the above-described drying device. The second drying device is disposed downstream from the second liquid applicator in the direction of conveyance of the medium. In the first drying device, the second surface of the medium contacts the plurality of heaters on the first path. In the second drying device, the first surface of the medium contacts the plurality of heaters on the first path.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
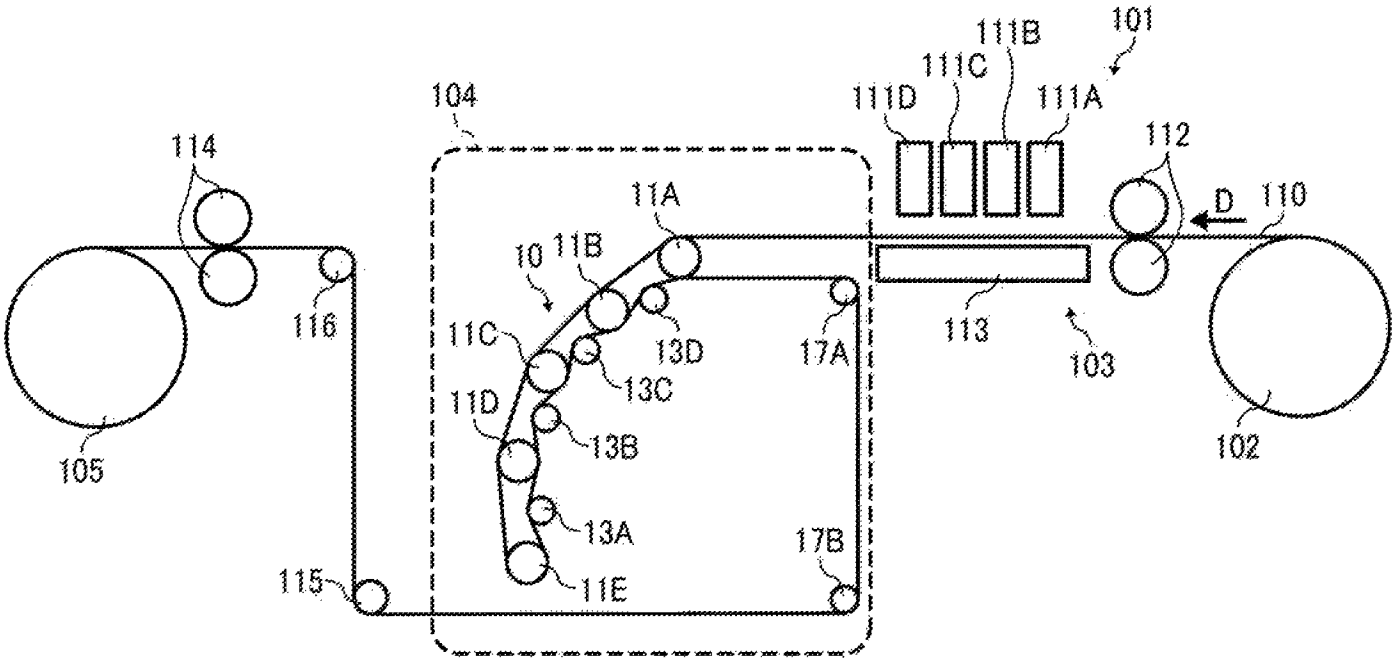
FIG. 1 is a schematic view of a printing apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, wherein like reference numerals designate identical or corresponding parts throughout the several views, embodiments of the present disclosure are described below. First, a printing apparatus according to a first embodiment of the present disclosure will be described with reference to FIG. 1. FIG. 1 is a schematic view of the printing apparatus according to the first embodiment.

The printing apparatus is an inkjet recording apparatus, and includes a liquid application unit 101 including a liquid discharge head, which is a liquid applicator, to discharge and apply ink, which is a color liquid, onto a continuous sheet 110, which is a medium (or member) to be conveyed.

In the liquid application unit 101, for example, full-line heads 111A, 111B, 111C, and 111D of four colors are disposed in this order from the upstream side in a conveyance direction of the continuous sheet 110 (indicated by arrow D). The heads 111 respectively applies liquids of black (K), cyan (C), magenta (M), and yellow (Y) onto the continuous sheet 110. The types and the number of colors are not limited to these types and numbers. Note that the number and types of color are not limited to the above-described four colors of K, C, M, and Y and may be any other suitable number and types.

The continuous sheet 110 is fed from a feeding roller 102, is sent onto a conveyance guide 113, which is disposed to face the liquid application unit 101, by conveyance rollers 112 of a conveyance unit 103 and is conveyed by being guided by the conveyance guide 113.

The continuous sheet 110 onto which the liquid is applied by the liquid application unit 101 passes a drying device 104 as the drying device according to the present embodiment, and is sent by ejection rollers 114 via rollers 115 and 116 and wound around a winding roller 105.

Figure 2:
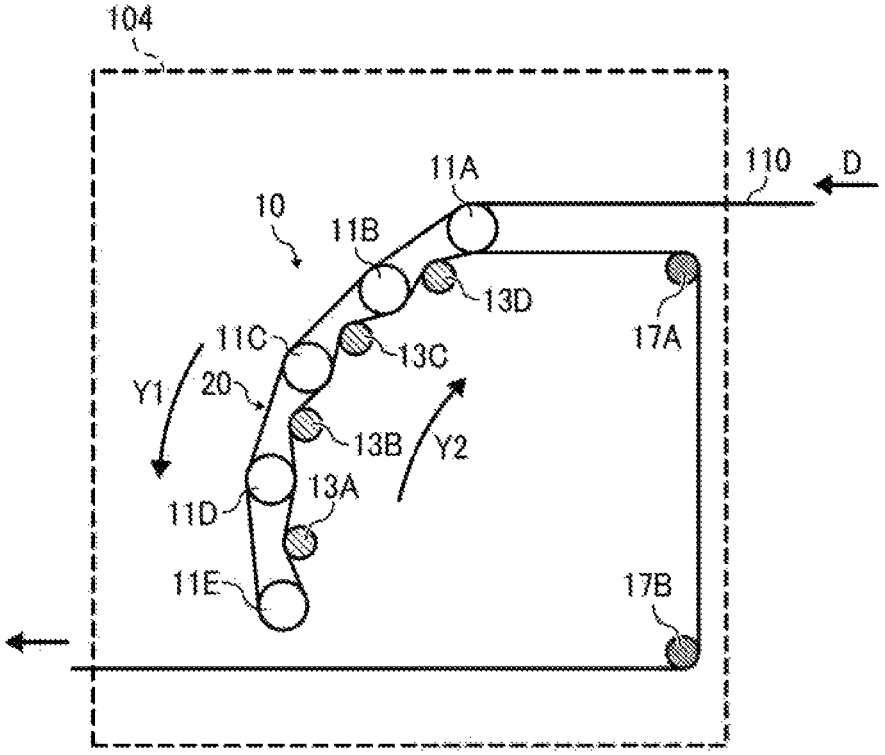
FIG. 2 is an enlarged view of a drying device according to the first embodiment.
Figure 3:
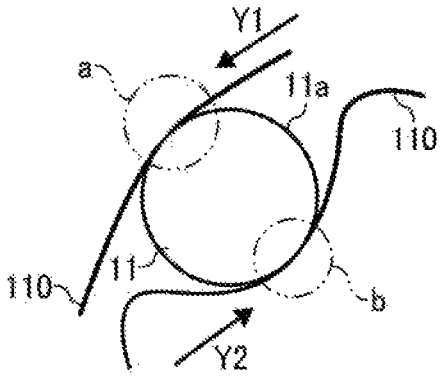
FIG. 3 is an illustration of a state of contact with a heating roller.

Next, the drying device according to the first embodiment will be described with reference to FIGS. 2 and 3. FIG. 2 is an enlarged view of the drying device, and FIG. 3 is an illustration for explaining a contact position of the continuous sheet to the heating roller.

The drying device 104 includes a contact heater 10 to heat the continuous sheet 110 in contact with a surface of the continuous sheet 110 on a side opposite to a surface onto which the liquid is applied. The drying device 104 further includes guide rollers 17A and 17B to guide the continuous sheet 110 that has passed through the contact heater 10.

The contact heater 10 includes heating rollers 11A to 11E as a plurality of first heaters having a curved contact face 11*a* that is a circumferential face to contact the continuous sheet 110. The contact heater 10 further includes contact guide rollers 13A to 13D as contact guides to guide the continuous sheet 110 to contact the contact faces 11*a* of the heating rollers 11D to 11A.

Here, a plurality of heating rollers 11A to 11E (hereinafter, also referred to as "heating rollers 11" unless distinguished, other members are also the same) are disposed side by side in an arcuate arrangement. Further, the contact guide roller 13 is disposed between adjacent ones of the heating rollers 11.

The contact heater 10 includes a conveyance path (conveyance passage, conveyance route) 20 of the continuous sheet 110 made up of the plurality of heating rollers 11 and the contact guide roller 13.

The conveyance path 20 includes a first path (hereinafter referred to as a "first path Y1") on which the continuous sheet 110 is conveyed in a first direction (Y1 direction) while contacting the plurality of heating rollers 11A to 11E, and a second path (hereinafter referred to as a "second path Y2") on which the continuous sheet 110 is conveyed in a second direction (Y2 direction) while contacting again the plurality of heating rollers 11D to 11A having contacted on the first path.

In the present embodiment, a path is formed on which the continuous sheet 110 contacts two or more heating rollers 11 (first heater) when the continuous sheet 110 is conveyed on the second path Y2. However, in some embodiments, a path may be formed on which the heater contacts a single heating roller 11 (the first heater). In other words, when the continuous sheet 110 is conveyed on the second path Y2, it is not necessarily required to convey the continuous sheet 110, while contacting all of the plurality of heating rollers 11A to 11E again.

Here, on the first path Y1, the continuous sheet 110 is conveyed on the outer side (a side which receives tension) of the plurality of heating rollers 11A to 11E disposed in an arcuate shape, while contacting the heating roller 11A to 11E. Thereafter, the direction of the continuous sheet 110 is turned on the second path Y2, and the continuous sheet 110 is guided on the inner side (loosening side) of the plurality of heating rollers 11E to 11A by the contact guide roller 13 and is conveyed while contacting the heating rollers 11D to 11A.

At this time, as illustrated in FIG. 3, the continuous sheet 110 is conveyed on the first path Y1 and the second path Y2, while simultaneously contacting the two spaced portions (portion a and portion b) of the same heating roller 11.

Thus, the media to be conveyed are simultaneously in contact with different two portions of the same heating member (the same heating roller) and are heated.

Accordingly, it is possible to efficiently dry the medium to be conveyed by a small heating member.

In the present embodiment, when conveyed on the first path Y1, even if the moisture of the ink applied to the continuous sheet 110 is evaporated and the heater is brought into direct contact with the liquid applied surface of the continuous sheet 110, the liquid is dried to the extent that the liquid is not transferred. Therefore, on the second path Y2, a contact guide roller 13 can be disposed on the liquid applied surface side of the continuous sheet 110.

Thereafter, by being conveyed on the second path Y2, the liquid is dried until a state in which it is possible to prevent the liquid on the front side from being transferred to the back side and peeled, when the continuous sheet 110 is wound around the winding roller 105.

Figure 4:
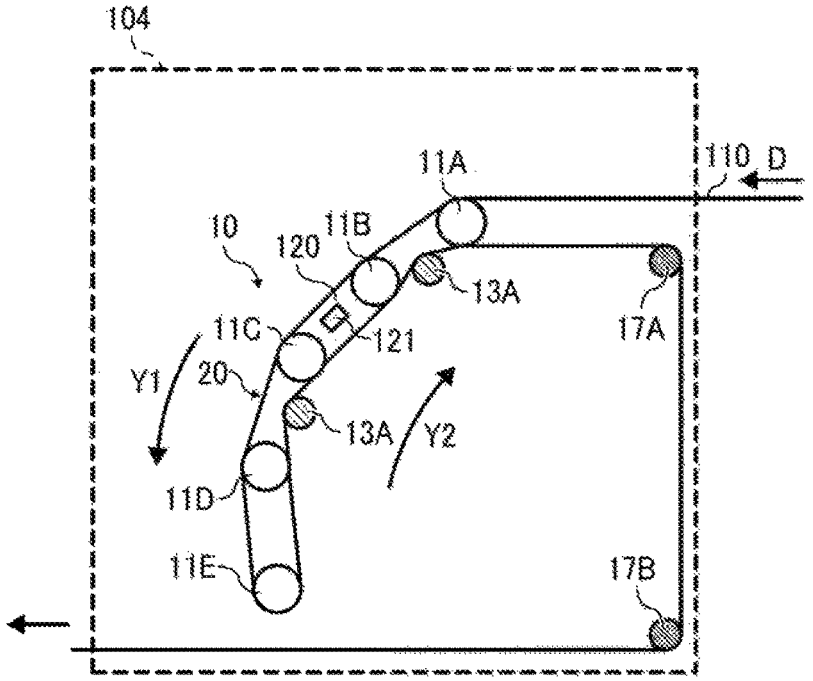
FIG. 4 is an enlarged view of the drying device according to a second embodiment of the present disclosure.

Next, a second embodiment of the present disclosure is described with reference to FIG. 4. FIG. 4 is an enlarged view of a portion of the drying device according to the second embodiment.

In the present embodiment, the configuration of the printing apparatus is also identical to the configuration of the first embodiment except for the drying device 104.

Further, in the drying device 104, there are places where a plurality of (two) heating rollers 11 is disposed between the contact guide rollers 13, 13 in the drying device 104 of the first embodiment.

Even with such a configuration, by the arrangement positions of the heating roller 11 and the contact guide roller 13, it is possible to guide the continuous sheet 110 so as to contact the heating roller 11 even when conveyed in the second direction Y2.

By the arrangement of the contact guide roller 13 of the present embodiment, a space 120 is formed between a portion of the continuous sheet 110 conveyed on the first path Y1 and a portion of the continuous sheet 110 conveyed on the second path Y2, between the heating rollers 11 in which the contact guide roller 13 is not disposed.

Therefore, for example, a sensor unit for temperature control of the heating roller 11 or a temperature control unit 121 for controlling the temperature can be disposed in the space 120.

Figure 5:
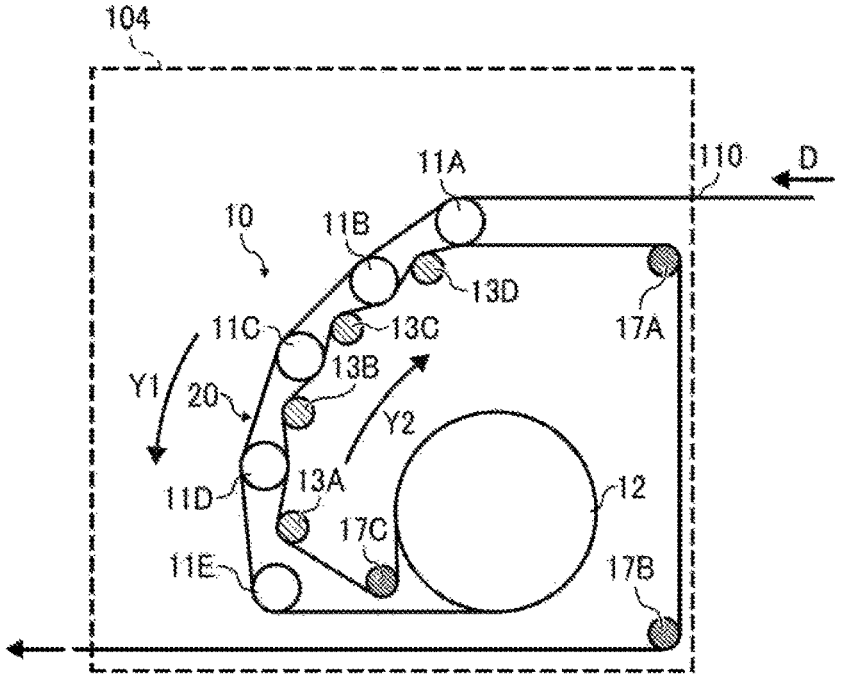
FIG. 5 is an enlarged view of the drying device according to a third embodiment of the present disclosure.

Next, a third embodiment of the present disclosure will be described with reference to FIG. 5. FIG. 5 is an enlarged view of a portion of the drying device according to the third embodiment.

In the present embodiment, the configuration of the printing apparatus is also identical to the configuration of the first embodiment except for the drying device 104.

In the drying device 104, the heating drum 12 as a second heater is disposed at a position downstream from the plurality of heating rollers 11 on the first path Y1 and upstream from the plurality of heating rollers 11 on the second path Y2. The heating drum 12 has a curved contact face (circumferential face) that has a curvature smaller than the contact face of the heating roller 11.

Here, the heating drum 12 is driven to rotate, and the heating roller 11 rotates with the continuous sheet 110 to be conveyed.

Further, the heating roller 11E, the heating drum 12, and the guide roller 17 form a path (conveyance path) on which the continuous sheet 110 is wound in a region of 70% or more, preferably 80% or more, around the heating drum 12. The heating drum 12 and the guide roller 17 turns the conveyance direction of the continuous sheet 110 from the direction of the first path Y1 to the direction of the second path Y2.

At this time, the contact distance of the continuous sheet 110 with respect to the heating drum 12 is longer than the contact distance of the continuous sheet 110 with respect to the heating roller 11. The "contact distance" is a distance in which the continuous sheet 110 contacts a circumferential surface of the heating drum 12 and the heating roller 11 in a direction along a circumferential direction of the heating drum 12 and the heating roller 11 (the conveyance direction). When the heater is a curved member having a curved surface as a contact face, the contact distance is a distance in which the continuous sheet 110 is in contact with the curved surface in the direction (conveyance direction) along the circumferential direction of the curved surface.

Here, the contact distance and the winding angle will be described with reference to FIGS. 6A and 6B.

Figure 6A:
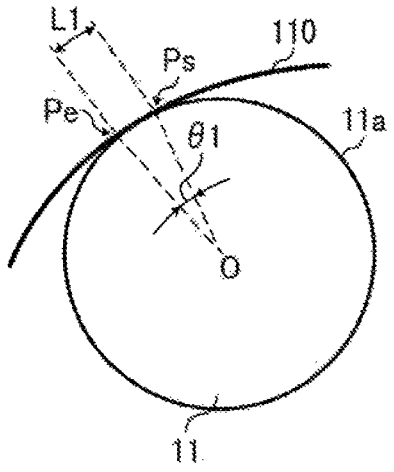
FIG. 6A is an illustration of the contact distance and winding angle of a continuous sheet with respect to a heating roller.
Figure 6B:
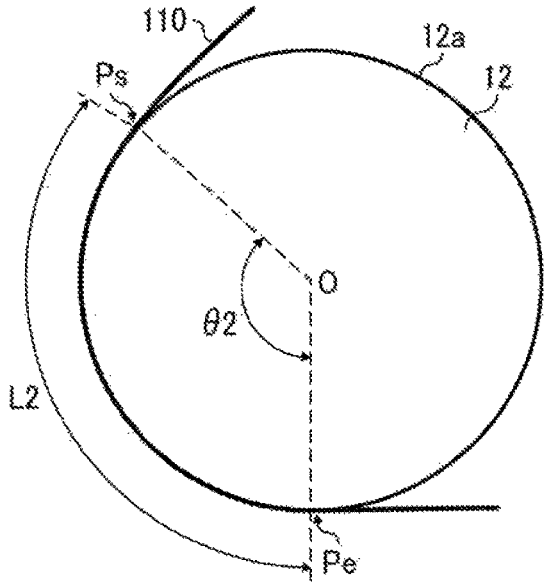
FIG. 6B is an illustration of the contact distance and winding angle of a continuous sheet with respect to a heating drum.

As illustrated in FIGS. 6A and 6B, the conveyance path is formed so that the contact distance L2 between the contact face 12*a* as the circumferential face of the heating drum 12 and the continuous sheet 110 is longer than the contact distance L1 between the contact face 11*a* as the circumferential face of the heating roller 11 and the continuous sheet 110.

Here, a winding angle θ2 of the continuous sheet 110 with respect to the contact face 12*a* of the heating drum 12 is greater than a winding angle θ1 of the continuous sheet 110 with respect to the contact face 11*a* of the heating roller 11 (θ2>θ1).

As illustrated in FIGS. 6A and 6B, the winding angles θ2 and θ1 (collectively referred to as a "winding angle θ") indicate angles of a point Ps at which the contact of the continuous sheet 110 with the contact faces 12*a* and 11*a* starts and a point Pe at which the contact of the continuous sheet 110 with the contact faces 12*a* and 11*a* ends, with respect to a center O.

Therefore, in a case where winding angle θ increases, the contact distance also increases insofar as rotary bodies have the same diameter, and even in a case where the winding angles θ are identical to each other, the contact distance increases as the diameter of the rotary body increases.

In the present embodiment, the diameter of the heating drum 12 is greater than the diameter of the heating roller 11, and the winding angle θ2 is greater than the winding angle θ1, and thus, in any case, the contact distance L2 between the contact face 12*a* of the heating drum 12 and the continuous sheet 110 is longer than the contact distance L1 between the contact face 11*a* of the heating roller 11 and the continuous sheet 110.

As described above, even in a case where the winding angles θ are identical to each other, the contact distance increases as the diameter of the rotary body increases. Therefore, by setting the heating drum 12 and the heating roller 11 to have the same diameter, and the winding angle θ2 to be greater than the winding angle θ1, the contact distance L2 between the contact face 12*a* of the heating drum 12 and the continuous sheet 110 is longer than the contact distance L1 between the contact face 11*a* of the heating roller 11 and the continuous sheet 110.

As a result, it is possible to heat and dry the continuous sheet 110 conveyed on the first path Y1 and heated by the heating roller 11, by applying a large amount of heat using the heating drum 12.

In this case, the continuous sheet 110 immediately after the application of liquid is conveyed on the first path Y1 while contacting the hearing roller 11, thus reducing the cockling. Since the continuous sheet 110 is wound around the heating drum 12 in this state, efficient drying can be performed, while bringing the continuous sheet 110 into close contact with the circumferential face of the heating drum 12.

That is, the strength of the continuous sheet 110 decreases in a state where a time does not elapse from the liquid application, and thus, it may be difficult to bring the continuous sheet 110 on a rear surface side closely into contact with a circumferential surface (a contact face) of the rotary body in a wide range (a long contact distance).

Therefore, in an initial state in which the applied liquid is not yet dried, the winding angle of the continuous sheet 110 with respect to the heating roller 11 is reduced to shorten the contact distance.

Here, by increasing the curvature of the heating roller 11, a tensile force generated at the time of conveying the continuous sheer 110 is changed to a pressing force in a contact portion with the heating roller 11, and thus, a contact state with respect to the heating roller 11 becomes even. In this state, an occurrence of cockling or wrinkling of the continuous sheet 110 is suppressed or corrected, and when passing through the plurality of heating rollers 11, there is a state in which it is possible to uniformly perform the heat supply required for drying with respect to the liquid on the continuous sheet 110.

Even if the contact distance between continuous sheet 110 and the rotary body (curved surface) increases, the continuous sheet 110 in which the cockling is reduced and the drying proceeds can be brought into close contact with the contact face.

Therefore, on the heating drum 12 disposed downstream from the plurality of heating rollers 11, by increasing the contact distance of the continuous sheet 110, large heat can be supplied to the continuous sheet 110 to perform the efficient drying in a short time.

Further, in the present embodiment, the back side of the continuous sheet 110 is brought into contact with the heating roller 11 again downstream from the heating drum 12.

Therefore, for example, by evaporating the moisture of the ink with the heat transfer of the heating roller 11 and the heat transfer of the heating drum 12 on the first path Y1, and thereafter, by evaporating the solvent of ink with the heat transfer of the heating roller 11 on the second path Y2, it is possible to fix the ink to the sheet as the continuous sheet 110.

Next, an example of a relationship between the roller diameter of the heating roller 11 and the cockling of the continuous sheet 110 will be described with reference to FIG. 7.

Figures 7, 8:
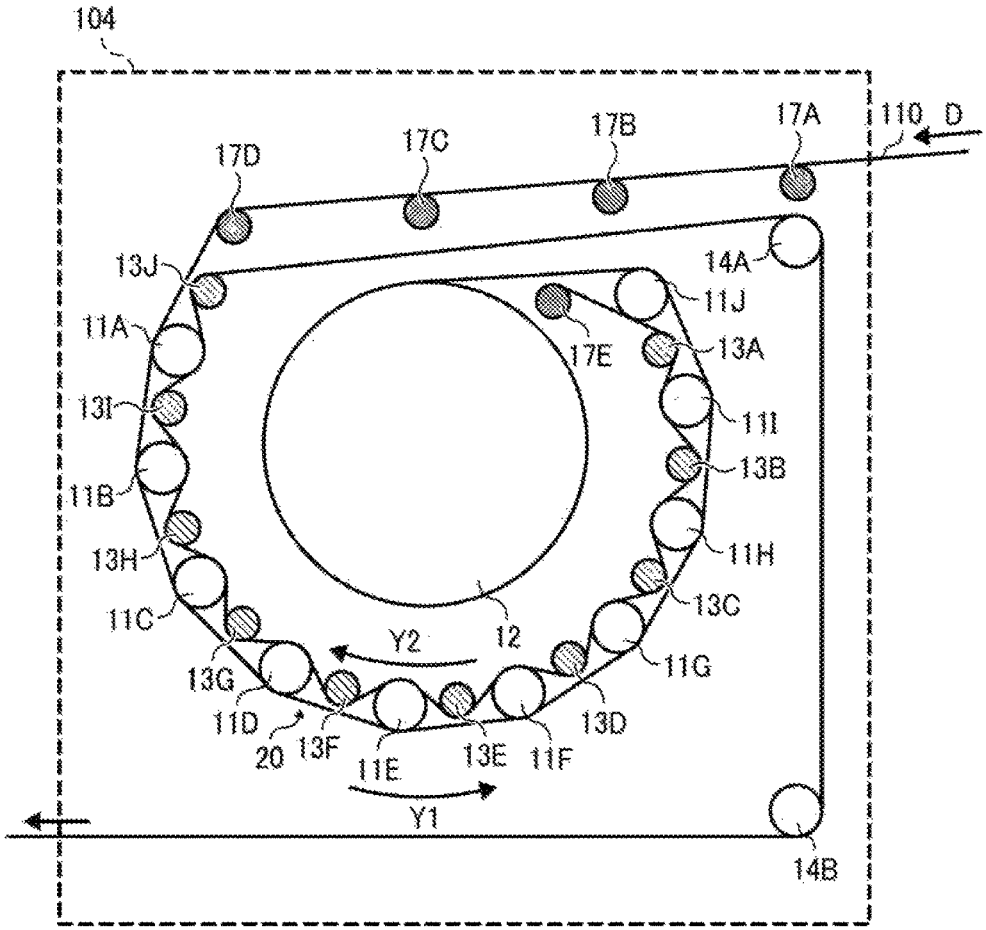
FIG. 7 is an illustration of a relationship between diameters of a heating roller and cockling.
FIG. 8 is an enlarged view of the drying device according to a fourth embodiment of the present disclosure.

FIG. 7 illustrates the results of measuring the height of cockling and the pitch of cockling occurring in the continuous sheet 110, and checking the presence or absence of visually observable cockling, by changing the diameter of the heating roller 11.

From this result, in this example, it is known that the cockling height is almost halved compared with a case where the diameter of the heating roller 11 is 250 mm, by setting the diameter of the heating roller 11 to 200 mm, and the cockling disappears by setting the diameter of the heating roller 11 to be 100 mm or less.

Therefore, the diameter of the heating roller 11 is preferably 200 mm or less, more preferably 100 mm or less.

Next, a fourth embodiment of the present disclosure will be described with reference to FIG. 8. FIG. 8 is an enlarged view of the drying device in the fourth embodiment.

In the present embodiment, the configuration of the printing apparatus is also identical to the configuration of the first embodiment except for the drying device 104.

The drying device 104 is provided with ten heating rollers 11 (11A to 11J) forming the contact heater 10, the heating drum 12, and contact guide rollers 13 (13A to 13J) that guide the continuous sheet 110 to contact the heating rollers 11 (11A to 11J).

The drying device 104 includes the guide rollers 17A to 17D to guide the continuous sheet 110 to the contact heater 10, and the guide roller 17E to wind the continuous sheet 110 around the heating drum 12. The drying device 104 includes heating rollers 14A and 14B that also function as guide rollers to guide the continuous sheet 110 from the contact heater 10.

In the contact heater 10, ten heating rollers 11 (11A to 11J) are disposed around the heating drum 12 in a circular arc arrangement. Here, the heating rollers 11 are disposed equidistantly from the center of the heating drum 12 to the center of each of the heating rollers 11. However, the center of the heating drum 12 is not necessary to be coincident with the center of a circular arc of the heating rollers 11, which are disposed in the circular arc arrangement.

Accordingly, a load is not applied to the continuous sheet 110 when the continuous sheet 110 is conveyed in contact with the plurality of heating rollers 11, thus allowing the continuous sheet 110 to be conveyed with a suitable tensile force.

The continuous sheet 110 guided to the contact heater 10 by the guide roller 17D is conveyed on the first path Y1 while contacting the outer side (the side opposite to the heating drum 12) of the plurality of heating rollers 11A to 11J disposed in the circular arc arrangement.

After that, the continuous sheet 110 reaches the circumferential face of the heating drum 12 and is wound around and brought into contact with substantially the entire circumference of the heating drum 12, and then is guided again to the heating roller 11J by the guide roller 17E and the contact guide roller 13A. The continuous sheet 110 is guided by the contact guide rollers 13A to 13J to the inner side (the side of the heating drum 12) of the heating rollers 11J to 11A and is conveyed on the second path Y2, while contacting heating rollers 11J to 11A.

As a result, even if the number of heaters increases, the size of the apparatus can be reduced. By increasing the number of heaters, drying speed can be increased.

Figure 9A:
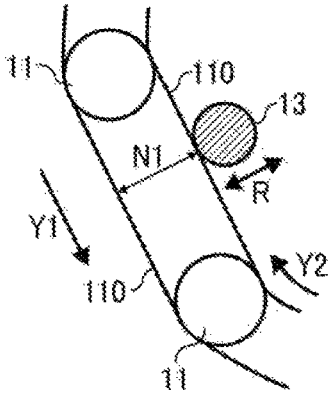
FIGS. 9A and 9B are enlarged views of a portion of the drying device according to a fifth embodiment of the present disclosure.
Figure 9B:
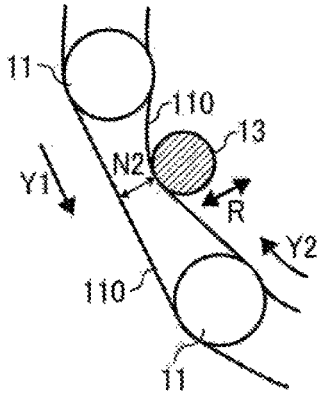

Next, a fifth embodiment of the present disclosure will be described with reference to FIGS. 9A and 9B. FIGS. 9A and 9B are enlarged views of a portion of the drying device in the fifth embodiment.

In the present embodiment, the contact guide roller 13 disposed between the adjacent heating rollers 11 is disposed to be movable in a direction of arrow R, between a first position illustrated in FIG. 9B at which the continuous sheet 110 to be conveyed is pressed against the heating roller 11 and a second position illustrated in FIG. 9A at which the continuous sheet 110 is not pressed against the heating roller 11. Therefore, the position of the contact guide roller 13 can be changed with respect to the conveyance path on the outer side of the group of the heating roller 11.

Further, the movement of the contact guide roller 13 can be performed manually, for example, by a steering wheel operation or the like, or can be performed by an actuator provided with a drive source.

Due to such a configuration, in order to improve the workability at the time of the initial loading of the continuous sheet 110, at the time of the loading operation, the contact guide roller 13 can be located at a retracted position separated from the conveyance path on the other side of the group of heating rollers 11 by a predetermined distance N1.

After loading the continuous sheet 110, the contact guide roller 13 is moved to a pressing position at which the contact guide roller 13 is located at a predetermined distance N2(N2<N1) with respect to the conveyance path on the outer side of the group of the heating roller 11, and the continuous sheet 110 is pressed against the inner side from a common circumscribed line of the adjacent heating rollers 11. This makes it possible to increase the contact region of the continuous sheet 110 with respect to the heating roller 11.

Figure 10:
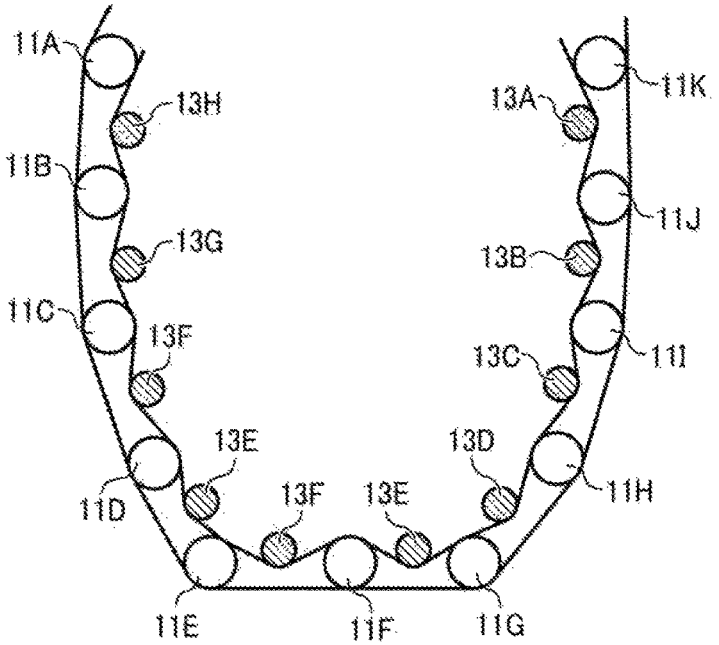
FIG. 10 is an enlarged view of a portion of the drying device according to a sixth embodiment of the present disclosure.

Next, a sixth embodiment of the present disclosure will be described with reference to FIG. 10. FIG. 10 is an enlarged view of a portion of the drying device in the sixth embodiment.

In the present embodiment, the first heating rollers 11A to 11K and the contact guide rollers 13A to 13H are arranged side by side, respectively.

Here, by interposing a path in which the heating rollers 11E, 11F and 11G are linearly arranged between the group of the first heating rollers 11A to 11E disposed in a curved arrangement and the group of the first heating rollers 11G to 11K, a part of the conveyance path is bent, and the straight path portion is included in the curved path.

That is, the shape of the conveyance path is not limited to a curved shape, and may include a linear shape (straight path) as a part (the present embodiment).

In the above embodiment, an example in which the plurality of first heaters and the plurality of second heaters are rotary bodies is described, but a part or the whole of the first and second heaters may not be the rotary bodies.

In each of the above-described embodiments, an example in which the conveyance path is a circular arc, an arcuate, or a curved path is described, but the present disclosure is not limited thereto. For example, it is also possible to employ a path bent in the middle of the Y1 direction (or Y2 direction), a crank-like path or the like.

Further, in each of the above-described embodiments, a configuration in which a plurality of first heaters is arranged in series is described, but a simple roller (rotary body) other than the heater may be disposed in the middle.

In each of the above-described embodiments, the term "medium" represents a medium or member to be conveyed by the drying device. In the above descriptions, an example has been described in which the medium to be conveyed is a continuous sheet. However, the medium to be conveyed is not limited to the continuous sheet. For example, a printed object, such as a sheet for an electronic circuit board, for example, wallpaper, prepreg, and the like, may be used in addition to a continuous body, such as a continuous sheet, a roll sheet, and a web, and a recording medium (a printed object) such as an elongated sheet material.

Not only is an image such as characters or figures recorded on the member that is conveyed by the printing apparatus by a liquid such as ink, but also a meaningless image such as a pattern may be applied onto the member by a liquid such as ink in order for decoration or the like.

Further, in each of the above-described embodiments, an example in which the second direction is opposite to the first direction is described. However, the second direction is not limited to the opposite direction, and may be a direction having an angle with respect to the first direction.

Figure 11:
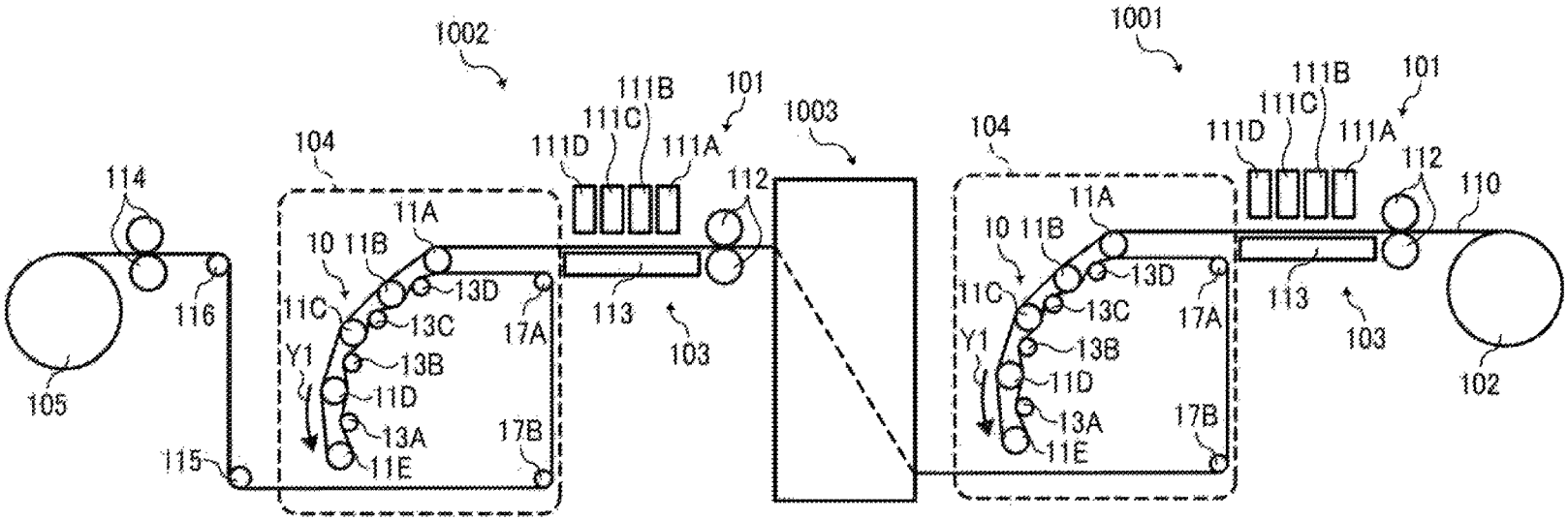
FIG. 11 is a schematic view of the printing apparatus according to a seventh embodiment of the present disclosure.

Next, a printing apparatus according to a twelfth embodiment of the present disclosure will be described with reference to FIG. 11. FIG. 11 is a schematic view of the printing apparatus.

In the printing apparatus, a first printing unit 1001 that performs printing and drying with respect to one surface of the continuous sheet 110, a reversing unit 1003 that reverses both surfaces of the continuous sheet 110 of which one surface is printed by the first printing unit 1001, and a second printing unit 1002 that performs printing and drying with respect to the other surface of the continuous sheet 110 are disposed between the feeding roller 102 and the winding roller 105.

The configuration of the liquid application unit 101, the conveyance unit 103, and the drying device 104 of the first printing unit 1001 and the second printing unit 1002 is approximately identical to (may be identical to) the configuration of the first embodiment, and can be identical to or approximately identical to the configuration of the second embodiment to the eleventh embodiment.

Here, the liquid application unit 101 of the first printing unit 1001 is a first liquid applicator applying the liquid onto a first surface of the continuous sheet 110, which is the medium to be conveyed. The liquid application unit 101 of the second printing unit 1002 is a second liquid applicator applying the liquid onto a second surface of the continuous sheet 110, which is the medium to be conveyed, on a side opposite to the first surface.

Further, the drying device 104 of the first printing unit 1001 serves as a first drying device in which the first surface of the continuous sheet 110 contacts the heating roller 11 on the first path Y1. The drying device 104 of the second printing unit 1002 serves as a second drying device in which the second surface of the continuous sheet 110 contacts the heating roller 11 on the first path Y1.

Herein, the liquid to be applied to the medium to be conveyed is not particularly limited, but it is preferable that the liquid has a viscosity of less than or equal to 30 mPa·s under a normal temperature and a normal pressure or by being heated or cooled. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

When a liquid discharge head is used as the liquid applicator, examples of an energy generation source discharging a liquid include an energy generation source using a piezoelectric actuator (a lamination-type piezoelectric element and a thin-film piezoelectric element), a thermal actuator using an electrothermal transducer element such as a heating resistor, a static actuator including a diaphragm plate and opposed electrodes, and the like.

Herein, the printing has the same meaning as the meaning of image formation, recording, printing, imprinting, and the like.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scone of the present disclosure and appended claims.

What is claimed is:

1. A drying device comprising:

a plurality of heaters disposed side by side in a direction of conveyance of a medium to contact and heat the medium to which liquid is applied; and a conveyance path on which the medium is conveyed while contacting the plurality of heaters, the conveyance path including:

a first path on which the medium is conveyed while contacting the plurality of heaters in a first contact, and a second path on which the medium is conveyed while contacting again in a second contact at least one of the plurality of heaters having contacted on the first path, wherein the second contact of the medium with the at least one of the plurality of heaters is not continuous with the first contact of the medium with the at least one of the plurality of heaters.

2. The drying device according to claim 1, wherein the plurality of heaters are a plurality of first heaters, wherein the drying device further comprises a second heater having a curved contact face with a curvature smaller than a contact face of each of the plurality of first heaters, wherein the second heater is disposed at a position downstream from the plurality of first heaters on the first path and upstream from the plurality of first heaters on the second path, and wherein a contact distance between the second heater and the medium in the direction of conveyance of the medium is longer than a contact distance between each of the plurality of first heaters and the medium in the direction of conveyance of the medium.

3. The drying device according to claim 2, wherein the plurality of first heaters are disposed around the second heater in a circular arc arrangement.

4. The drying device according to claim 3, wherein the first path is an outer path of the plurality of first heaters disposed in the circular arc arrangement with respect to the second heaters, and wherein the second path is an inner path of the plurality of first heaters disposed in the circular arc arrangement with respect to the second heater.

5. The drying device according to claim 1, wherein the plurality of heaters are disposed to contact another surface of the medium opposite to the surface of the medium to which the liquid is applied.

6. A printing apparatus comprising:

a liquid applicator to apply the liquid to the medium; and the drying device according to claim 1 to dry the medium to which the liquid is applied.

7. The drying device according to claim 1, wherein the plurality of heaters are disposed side by side in a curved arrangement or in an arcuate arrangement, wherein the first path is a path outside the plurality of heaters disposed in the curved arrangement or the arcuate arrangement, and wherein the second path is a path inside the plurality of heaters disposed in the curved arrangement or the arcuate arrangement.

8. The drying device according to claim 1, further comprising a contact guide to guide the medium to contact the plurality of heaters when the medium is conveyed on the second path.

9. The drying device according to claim 8, wherein the contact guide is disposed between adjacent heaters of the plurality of heaters.

10. The drying device according to claim 8, wherein two or more heaters of the plurality of heaters are disposed between the contact guide and another contact guide adjacent to the contact guide.

11. The drying device according to claim 8, wherein the contact guide contacts a surface of the medium to which the liquid is applied.

12. The drying device according to claim 8, wherein the contact guide is movable between a first position at which the contact guide presses the medium against the plurality of heaters and a second position at which the contact guide does not press the medium against the plurality of heaters.

13. A drying device comprising:

a plurality of heaters disposed side by side in a direction of conveyance of a medium to contact and heat the medium to which liquid is applied; and a conveyance path on which the medium is conveyed while contacting the plurality of heaters, the conveyance path including:

a first path on which the medium is conveyed while contacting the plurality of heaters, and a second path on which the medium is conveyed while contacting again at least one of the plurality of heaters having contacted on the first path, wherein the plurality of heaters are disposed side by side in a curved arrangement or in an arcuate arrangement, wherein the first path is a path outside the plurality of heaters disposed in the curved arrangement or the arcuate arrangement, and wherein the second path is a path inside the plurality of heaters disposed in the curved arrangement or the arcuate arrangement.

14. A drying device comprising:

a plurality of heaters disposed side by side in a direction of conveyance of a medium to contact and heat the medium to which liquid is applied;

a conveyance path on which the medium is conveyed while contacting the plurality of heaters, the conveyance path including:

a first path on which the medium is conveyed while contacting the plurality of heaters, and a second path on which the medium is conveyed while contacting again at least one of the plurality of heaters having contacted on the first path; and a contact guide to guide the medium to contact the plurality of heaters when the medium is conveyed on the second path.

15. The drying device according to claim 14, wherein the contact guide is disposed between adjacent heaters of the plurality of heaters.

16. The drying device according to claim 14, wherein two or more heaters of the plurality of heaters are disposed between the contact guide and another contact guide adjacent to the contact guide.

17. The drying device according to claim 14, wherein the contact guide contacts a surface of the medium to which the liquid is applied.

18. The drying device according to claim 14, wherein the contact guide is movable between a first position at which the contact guide presses the medium against the plurality of heaters and a second position at which the contact guide does not press the medium against the plurality of heaters.

19. A printing apparatus comprising:

a first liquid applicator to apply liquid to a first surface of the medium;

a first drying device constituted of the drying device according to claim 1, the first drying device disposed downstream from the first liquid applicator in the direction of conveyance of the medium;

a second liquid applicator to apply liquid onto a second surface of the medium, which is opposite to the first surface of the medium, the second liquid applicator disposed downstream from the first drying device in the direction of conveyance of the medium; and a second drying device constituted of the drying device according to claim 1, the second drying device disposed downstream from the second liquid applicator in the direction of conveyance of the medium, wherein, in the first drying device, the second surface of the medium contacts the plurality of heaters on the first path, and wherein in the second drying device, the first surface of the medium contacts the plurality of heaters on the first path.

* * * * *